US005526791A

United States Patent [19]

Timmer et al.

[11] Patent Number: 5,526,791

[45] Date of Patent: Jun. 18, 1996

[54] HIGH-PRESSURE ELECTROMAGNETIC FUEL INJECTOR

[75] Inventors: Robert C. Timmer, Grandville; Robert D. Straub, Lowell; Richard F. Teerman, Wyoming; Beckie J. DeYoung, Stanwood; Michael VanAllsburg, Grand Rapids, all of Mich.

[73] Assignee: Diesel Technology Company, Wyoming, Mich.

[21] Appl. No.: 487,123

[22] Filed: Jun. 7, 1995

[51] Int. Cl.[6] ..... F02M 69/04

[52] U.S. Cl. ..... 123/467; 123/506

[58] Field of Search ..... 123/446, 447, 123/467, 506; 239/96, 585.1, 585.3

[56] References Cited

U.S. PATENT DOCUMENTS

| | | | |
|---|---|---|---|
| 2,279,010 | 4/1942 | Nichols . | |
| 3,610,529 | 10/1971 | Huber | 239/96 |
| 3,802,626 | 4/1974 | Regneault et al. | 239/96 |
| 4,211,202 | 7/1980 | Hafner | 123/467 |
| 4,249,497 | 2/1981 | Eheim et al. | 123/446 |
| 4,448,169 | 5/1984 | Badgley | 123/467 |
| 4,475,515 | 10/1984 | Mowbray | 123/467 |
| 4,545,352 | 10/1985 | Jourde et al. | 123/447 |
| 4,603,671 | 8/1986 | Yoshinaga et al. | 123/467 |
| 4,993,637 | 2/1991 | Kanesaka | 239/96 |
| 5,395,048 | 3/1995 | Ricco et al. | 239/96 |
| 5,441,028 | 8/1995 | Felhofer | 123/467 |
| 5,441,029 | 8/1995 | Hlousek | 123/446 |
| 5,472,142 | 12/1995 | Iwanaga | 239/96 |

*Primary Examiner*—Thomas N. Moulis
*Attorney, Agent, or Firm*—Brooks & Kushman

[57] ABSTRACT

A high-pressure electromagnetic fuel injector having a dual-function valve directly controlled by an electric solenoid. Fuel pressure in a control volume chamber is controlled by the dual-function valve, and a separate control valve is controlled as a function of fuel pressure in the control volume chamber. A spray tip valve is, in turn, controlled as a function of the pressure of fuel controlled by the control valve to inject fuel through a spray tip orifice. The dual-function valve spills fuel during and after the control valve closes, thus reducing the amount of uncontrolled fuel at the end of an injection. The dual-function valve also provides a drain path through which to vent any fuel that leaks past the control valve.

16 Claims, 2 Drawing Sheets

HIGH-PRESSURE ELECTROMAGNETIC FUEL INJECTOR

TECHNICAL FIELD

This invention relates to fuel injectors for engines, and particularly to a unit fuel injector having a solenoid-actuated, dual-function valve, a control valve and a spray tip valve.

BACKGROUND INFORMATION

Solenoid-actuated, unit fuel injectors have been used for some time to inject liquid fuel into an engine. Typically, a fuel injector includes an electric solenoid that positions a valve to discontinue fuel drain flow during a fuel injection period, thereby allowing fuel pressure to increase sufficiently to unseat a spray tip valve. The spray tip valve is allowed to reseat when fuel pressure subsequently drops upon deactuation of the solenoid.

Injection pressures of such devices are generally dependent on engine speed and fuel output. At lower engine speeds and fuel outputs, injection pressure falls off, producing less than an optimum fuel injection process for good combustion.

While the prior fuel injectors function with a certain degree of efficiency, none disclose the advantages of the improved fuel injector of the present invention as is hereinafter more fully described.

DISCLOSURE OF THE INVENTION

An object of the present invention is to provide an improved high-pressure electromagnetic fuel injector that provides for electromechanical control of high-pressure fuel by including a dual-function valve that controls movement of a separate control valve to initiate and control the duration of fuel flow regardless of engine speed.

Another object of the present invention is to provide a fuel injector that reduces the amount of uncontrolled fuel at the end of an injection period by including a dual-function valve that spills fuel during and after control valve closure, thus reducing the amount of fuel supplied to the spray tip.

Still another object of the present invention is to provide a fuel injector including a dual-function valve that provides a drain path through which to vent any fuel that leaks past the control valve.

An advantage of the present invention is that the fuel injector provides a softer initial rate of injection, which is comparable with a standard unit fuel injector because it uses a standard unit fuel injector spray tip and spring system.

Another advantage of the present invention is that the fuel injector provides a more constant mean injection pressure because of its compatibility with a variable, high-pressure fuel supply.

Yet another advantage of the present invention is that the fuel injector provides a variable injection pressure regardless of engine speed because of its compatibility with a variable, high-pressure fuel supply.

A feature of the present invention is that it provides for the optional use of any one of numerous rate-controlling and timing accuracy improving devices used with standard nozzles, these devices including, but not limited to, a two-stage spray tip needle valve lift, a pilot/main valve, a volume retraction piston, a start/stop valve and a spray tip needle valve lift indicator.

In realizing the aforementioned and other objects, advantages and features, the high-pressure electromagnetic fuel injector of the present invention includes a housing defining therein a fuel supply passage connectable to a source of high-pressure fuel, a fuel drain passage connectable to a fuel source return, a spray tip orifice, and a fuel spill passage communicating with the fuel supply passage, the fuel drain passage and the spray tip orifice.

An electric solenoid is mounted on the housing. A dual-function valve is disposed in the housing and is responsive to the electric solenoid to control fuel flow between the fuel spill passage and the fuel drain passage and between the fuel supply passage and the fuel drain passage.

A control volume chamber is also defined in the housing to receive fuel from the fuel supply passage and to communicate the fuel to the fuel drain passage. The rate of fuel flow from the control volume chamber is greater than rate of fuel flow into the control volume chamber.

A control valve is disposed in the housing to control fuel flow between the fuel supply passage and the fuel drain passage and between the fuel supply passage and the fuel spill passage as a function of fuel pressure in the control volume chamber. A spray tip valve is disposed in the housing to control fuel flow from the fuel spill passage through the spray tip orifice as a function of fuel pressure in the fuel spill passage.

The objects and advantages of the present invention are readily apparent from the following detailed description of the best mode for carrying out the invention when taken in connection with the accompanying drawing.

BRIEF DESCRIPTION OF THE DRAWING

A more complete appreciation of the invention and many of the attendant advantages thereof may be readily obtained by reference to the following detailed description when considered with the accompanying drawing in which like reference characters indicate corresponding parts in all the views, wherein.

BEST MODE FOR CARRYING OUT THE INVENTION

Figure 1:
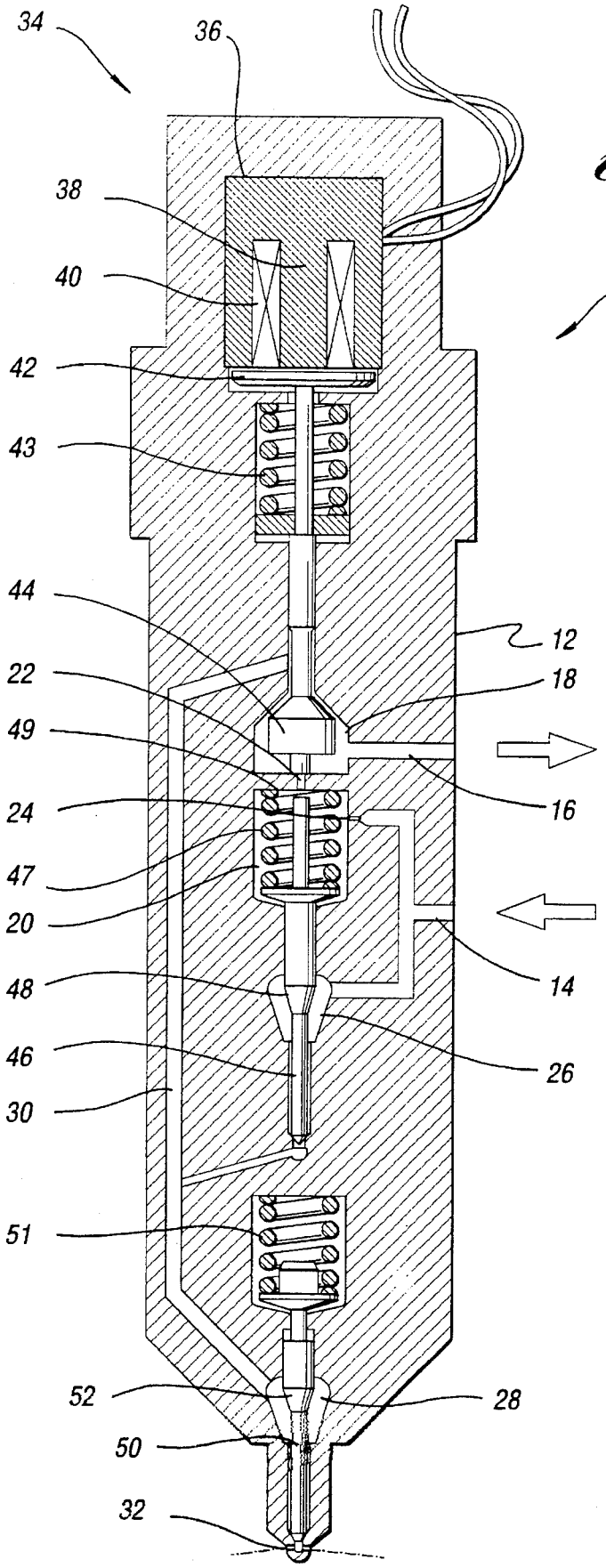
FIG. 1 is a sectional view of the high-pressure electromagnetic fuel injector of the present invention.

FIG. 1 of the drawing is a sectional view of a preferred embodiment of a high-pressure electromagnetic fuel injector, generally indicated by reference numeral 10, constructed in accordance with the present invention. The fuel injector 10 includes a housing 12 defining therein a fuel supply passage 14 connectable to a source of high-pressure fuel and a fuel drain passage 16 connectable to a fuel source return.

The housing 12 also defines therein a dual-function valve chamber 18 in communication with the fuel drain passage 16 and a control volume chamber 20. A first orifice 22 extends between the dual-function valve chamber 18 and the control volume chamber 20, and a second orifice 24 extends between the control volume chamber 20 and the fuel supply passage 14. The first orifice 22, having a larger diameter than that of the second orifice 24, has a greater capacity for fuel flow than does the second orifice 24. A control valve chamber 26 is also defined within the housing 12 and is in communication with the fuel supply passage 14.

Also defined within the housing 12 is a spray tip valve chamber 28 A fuel spill passage 30 extends from the dual-function valve chamber 18 to the control valve chamber 26 and to the spray tip valve chamber 28. A spray tip orifice 32 extends from the spray tip valve chamber 28 to carry fuel to its point of ejection from the housing 12.

An electric solenoid, generally indicated by reference numeral 34, includes a stator 36 mounted on the housing 12. The stator 36 includes a stator core 38 with an electric coil 40 wound thereon, the coil 40 being controllably connected to a source of electric energy (not shown) so that energization of the electric solenoid 34 can be electronically controlled.

An electric solenoid armature 42 is movably mounted within the housing 12 magnetically proximate the stator core 38. The armature 42 is resiliently biased away from the core 38 by an armature coil spring 43.

A dual-function valve 44 is slidably disposed within the dual-function valve chamber 18 and is rigidly connected to the armature 42 to move therewith. The dual-function valve 44 is resiliently maintained by the armature coil spring 43 in a normal position against the first orifice 22. In this position, the dual-function valve 44 isolates the first orifice 22, and hence the fuel supply passage 14, from the fuel drain passage 16. The normal position of the dual-function valve allows communication between the fuel spill passage 30 and the fuel drain passage 16.

When electric energy is supplied to the coil 40 of the electric solenoid 34, the armature 42 is drawn toward the stator core 38. This moves the dual-function valve 44 into a position that isolates the fuel spill passage 30 from the fuel drain passage 16. This position allows communication between the first orifice 22 and the fuel drain passage 16 and thereby allows fuel to flow from the fuel supply passage 14, through the second orifice 24, and through the first orifice 22 to the fuel drain passage 16.

A control valve 46 is slidably disposed within the control valve chamber 26 and extends into the control volume chamber 20. The control valve 46 is resiliently maintained by a control valve coil spring 47 in a normal position that isolates the fuel supply passage 14 from the fuel spill passage 30. This position allows communication between the fuel supply passage 14 and the first orifice 22 through the second orifice 24. Since the fuel flow rate is greater through the first orifice 22 than through the second orifice 24, the communication between the first orifice 22 and the fuel drain passage 16 causes fuel pressure in the control volume chamber 20 to drop.

The control valve 46 has a differential portion 48 responsive to fuel pressure to urge the control valve 46 away from its normal position to a position that allows communication between the fuel supply passage 14 and the fuel spill passage 30. When the dual-function valve 44 is moved away from its normal position, fuel pressure in the control volume chamber 20 drops; and pressure against the differential portion 48 of the control valve 46 is sufficient to overcome the resilient force of the control valve coil spring 47 and the fuel pressure acting on the control valve 46.

This forces the control valve 46 toward an associated control valve stop 49 adjacent the first orifice 22. In this position, the control valve 46 restricts fuel flow from the fuel supply passage 14 through the first orifice 22. The restricted fuel flow through the first orifice 22 in turn increases fuel pressure in the control volume chamber 20, which keeps the control valve 46 from contacting the control valve stop 49 and completely restricting fuel flow through the first orifice 22 and hence through the fuel drain passage 16.

A spray tip valve 50 is slidably disposed in the spray tip chamber 28. The spray tip valve 50 is resiliently maintained by a spray tip valve coil spring 51 in a normal position. This position isolates the fuel spill and fuel supply passages, 30 and 14 respectively, from the spray tip orifice 32, thereby preventing any fuel from being ejected.

The spray tip valve 50 has a differential portion 52 responsive to fuel pressure to urge the spray tip valve 50 away from its normal position to a position allowing communication between the fuel spill and fuel supply passages, 30 and 14 respectively, and the spray tip orifice 32. This allows fuel to be ejected from the fuel injector 10 until the electric solenoid 34 is no longer energized.

When electric energy is removed from the coil 40 of the electric solenoid 34, the dual-function valve 44 is allowed to return to its normal position. When this occurs, the dual-function valve 44 seals off the first orifice 22 and allows fuel to flow from the fuel spill passage 30 to the fuel drain passage 16. A resulting increase in the fuel pressure of the control volume chamber 20 causes the control valve 46 to return to its normal position and isolate the fuel supply passage 14 from the fuel spill passage 30. The fuel pressure in the fuel spill passage 30 and in the spray tip valve chamber 28 accordingly drops, causing the spray tip valve 50 to return to its normal position and isolate the spray tip valve chamber 28 from the spray tip orifice 32. This terminates fuel ejection from the injector 12 pending the reception of the next electric energy pulse to the coil 40 of the electric solenoid 34 generally indicated by the command pulse 100.

Figure 2:
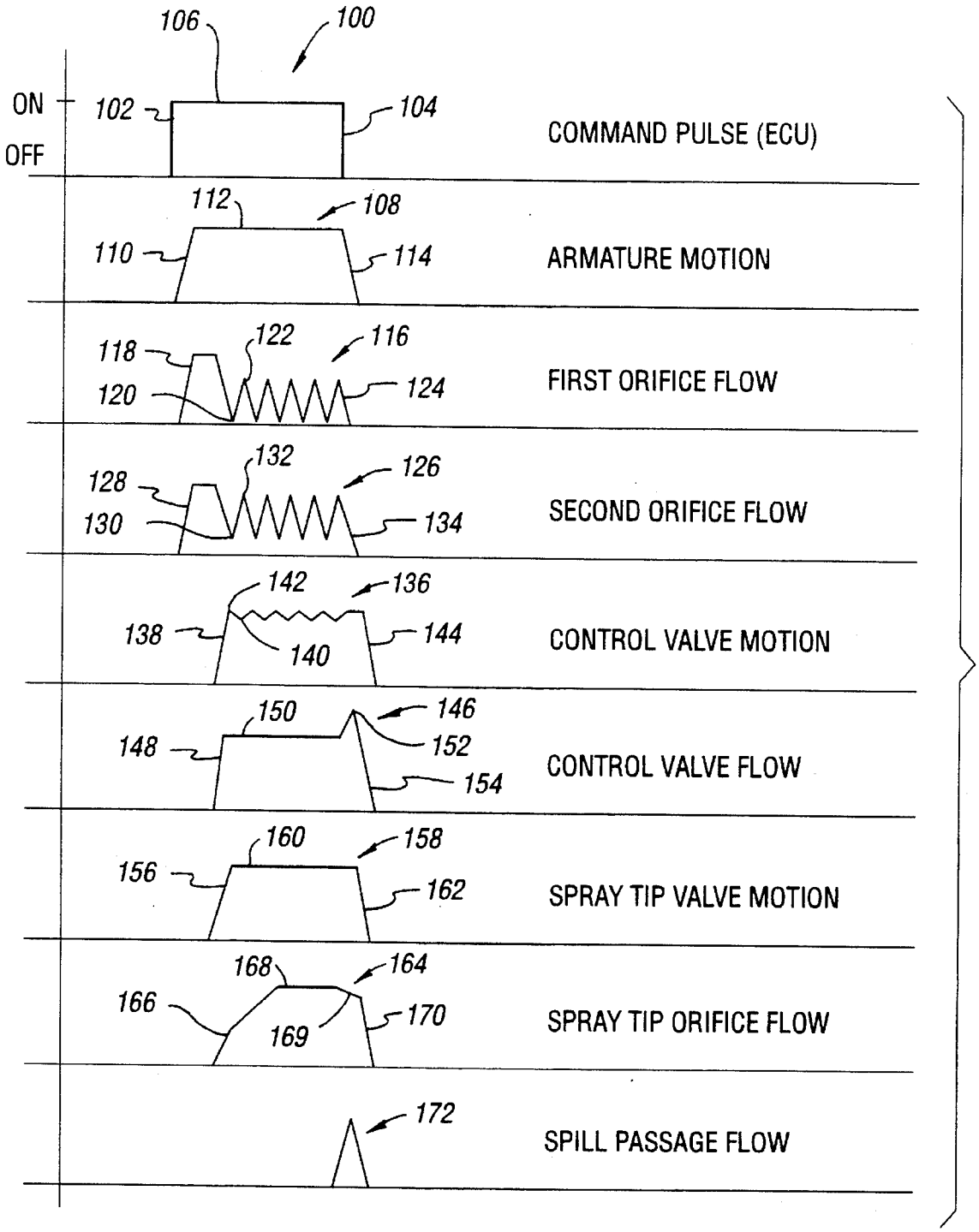
FIG. 2 is a graphic representation of an electric pulse compared over time with representations of relative valve motions and fuel flows.

FIG. 2 of the drawing is a graphic representation of the aforementioned command pulse 100 compared over time with representations of relative armature and valve motions and fuel flows. An understanding of the operation of the high-pressure electromagnetic fuel injector can be facilitated by reference to FIGS. 1 and 2.

The command pulse 100 is shown as a wave form having substantially negligible rise and fall times and amplitude variations as respectively indicated by portions 102, 104 and 106 thereof. When the electric energy is applied to the coil 40, an electromagnetic field is produced that attracts the solenoid armature 42 toward the stator core 38.

Motion of the solenoid armature 42 is represented by the armature motion graph, generally indicated by reference numeral 108. As indicated, the solenoid armature 42 is attracted toward the stator core 38 shortly after the electric energy is applied to the coil 40. This is represented by the leading edge portion 110 of the armature motion graph 108. The solenoid armature 42 is held in the attracted position, as represented by an armature motion displacement amplitude portion 112, and is returned to its normal position by the armature coil spring 43 when the command signal is removed from the solenoid coil 40, this motion being represented by the trailing edge portion 114 of the armature motion graph 108.

Since the dual-function valve 44 is attached to the armature 42, the former moves with the latter. Its motion is therefore also represented by the armature motion graph 108. The dual-function valve 44 is displaced from its normal position, as shown in FIG. 1, when the electric solenoid 34 is energized. This displacement isolates the fuel spill passage 30 from the fuel drain passage 16 and allows fuel to flow from the fuel supply passage 14, through the second orifice 24, and through the first orifice 22 to the fuel drain passage 16.

Fuel flow through the first orifice 22 and the second orifice 24 is respectively represented by first and second orifice flow graphs, generally indicated by reference numerals 116 and 126 respectively. These flows are functions of the movement of the dual-function valve 44. Fuel begins to flow when the dual-function valve 44 is moved away from the first orifice 22. This flow is represented by the leading edges 118 and 128 of the respective first and second orifice flow graphs 116 and 126.

Since the first orifice 22 has a larger diameter than does the second orifice 24, fuel flows out of the control volume chamber 20 faster than it flows in. This causes the fuel pressure therein to drop. Fuel pressure against the differential portion 48 of the control valve 46 in the control valve chamber 26 is then sufficient to force the control valve 46 toward the associated control valve stop 49. This movement is represented by the leading edge 138 of a control valve motion graph, generally indicated by reference numeral 136.

The resulting restriction placed by the control valve 46 on fuel flow through the first orifice 22 increases fuel pressure in the control volume chamber 20 and thereby prevents the control valve 46 from contacting the control valve stop 49, which would completely restrict fuel flow through the first orifice 22 and thus through the fuel drain passage 16. The control valve 46 reaches a maximum displacement, as represented by the maximum point 142 on the control valve motion graph 136, and then recoils somewhat to a position represented by the minimum point 140 as a result of the increasing fuel pressure in the control volume chamber 20.

As depicted in graph 36, the control valve 46 alternates, or "floats," between maximum and minimum positions. The maximum points 142 and minimum points 140 of the control valve motion graph 136 respectively correspond to the minimum points 120 and 130 and maximum points 122 and 132 of the first and second orifice graphs 116 and 126. From peak to peak, the amplitudes of all maximum points 122, 132 and 142 are equal to one another. Likewise, there is no substantive change in the amplitudes of minimum points 120,130 and 140. This depiction may be somewhat theoretical. In actual operation, control valve 46 position is governed by it closing off orifice 22. It may seek an equilibrium position a fixed distance from orifice 22 or may oscillate (as shown), depending on dynamics. Furthermore, the degree of oscillation will not necessarily be equal as shown in graph 136.

When the dual-function valve 44 returns to its normal position, fuel flow through the first orifice 22 and the second orifice 24 ceases; and the control valve 46 returns to its normal position also. This is represented by the trailing edge portions 124, 134 and 144 of the respective first orifice flow, second orifice flow and control valve motion graphs 116, 126 and 136.

Fuel flow through the control valve 46 is represented by a control valve flow graph, generally indicated by reference numeral 146. Control valve fuel flow begins, as represented by the leading edge 148 of the control valve flow graph 146, and maintains a substantially constant amplitude, as represented by a control valve flow amplitude portion 150. When the dual-function valve 44 returns to its normal position, fuel from the fuel spill passage 30 is allowed to flow to the fuel drain passage 16. This causes fuel pressure in the fuel spill passage 30 to drop. The drop in pressure presents less resistance to the flow of fuel through the control valve 46.

The drop in resistance and the plunger action of the control valve 46 as it returns to its normal position causes a surge in the flow of fuel through the control valve 46. The surge is represented by the spike 152 following portion 150 of the control valve flow graph 146. As the control valve 46 continues to close, the fuel flow therethrough diminishes, as represented by the trailing edge 154 of the control valve flow graph 146.

As fuel flows through the control valve 46, pressure increases in the spray tip valve chamber 28. Fuel pressure against the differential portion 52 of the spray tip valve 50 urges it away from its normal position. This is represented by the leading edge 156 of a spray tip valve motion graph, generally indicated by reference numeral 158. The spray tip valve 50 remains displaced from its normal position, as represented by a spray tip valve displacement amplitude portion 160, until fuel pressure in the spray tip valve chamber 28 decreases as a result of the dual-function valve 44 returning to its normal position. This is represented by the trailing edge 162 of the spray tip valve motion graph 158.

Fuel flow through the spray tip orifice 32 is represented by a spray tip orifice flow graph, generally indicated by reference numeral 164. When the spray tip valve 50 is displaced from its normal position, fuel begins to flow, as represented by the leading edge 166 of the spray tip orifice flow graph 164, through the spray tip orifice 32. As is also represented thereby, the rate of increase of fuel flow is reduced once the fuel tip spray valve 50 has been fully displaced from its normal position.

Fuel flow remains relatively constant, as represented by the spray tip orifice flow amplitude portion 168, until fuel pressure in the spray tip valve chamber 28 decreases as a result of the dual-function valve 44 returning to its normal position. When the fuel pressure begins to drop in the spray tip valve chamber 28, the rate of fuel flow through the spray tip orifice 32 also begins to drop, as represented by the spray tip orifice flow amplitude portion 169. When the spray tip valve closes, fuel flow through the spray tip orifice 32 drops rapidly, as represented by the trailing edge 170 of the spray tip orifice flow graph 164.

As the dual-function valve 44 returns to its normal position, any fuel under pressure in the fuel spill passage 30 and spray tip valve chamber 28 is allowed to flow to the fuel drain passage 16. Fuel is spilled during and after the time the control valve 46 returns to its normal position. This reduces the amount of uncontrolled fuel at the end of an injection period by reducing the amount of fuel supplied to the spray tip chamber 28. This is represented by the spill passage flow graph, generally indicated by reference numeral 172. The dual-function valve 44 also provides a drain through which to vent any fuel that leaks past the control valve 46.

It should be noted that the preferred embodiment of the high-pressure electromagnetic fuel injector uses a standard injector spray tip and spring system. The preferred embodiment of the present invention is also compatible with a variable, high-pressure fuel supply; and it thereby provides a relatively constant mean injection pressure. This latter feature also provides for variable injection pressure regardless of engine speed.

As one having ordinary skill in the art should recognize, the preferred embodiment of the present invention provides for the optional use of any one of numerous rate-controlling and timing accuracy improving devices used with standard nozzles. These devices include, but are not limited to, a two-stage spray tip needle valve lift, a pilot/main valve, a volume retraction piston, a, start/stop valve and a spray tip needle valve lift indicator.

While the best mode for carrying out the invention has been described in detail, those familiar with the art to which this invention relates should recognize various alternative designs and embodiments for practicing the invention as defined by the following claims.

What is claimed is:

1. A high-pressure electromagnetic fuel injector, comprising:

a housing defining therein a fuel supply passage connectable to a source of high-pressure fuel, a fuel drain passage connectable to a fuel source return, a spray tip orifice, and a fuel spill passage communicating with the fuel supply passage, the fuel drain passage and the spray tip orifice;

an electric solenoid mounted on the housing;

dual-function valve means for controlling fuel flow between the fuel spill passage and the fuel drain passage and between the fuel supply passage and the fuel drain passage as a function of electric solenoid energization;

control volume means for receiving fuel from the fuel supply passage and communicating the fuel to the fuel drain passage, fuel flow from the control volume means being greater than fuel flow into the control volume means;

control valve means for controlling fuel flow between the fuel supply passage and the fuel drain passage and between the fuel supply passage and the fuel spill passage as a function of fuel pressure in the control volume means; and spray tip valve means for controlling fuel flow from the fuel spill passage through the spray tip orifice as a function of fuel pressure in the fuel spill passage.

2. The high-pressure electromagnetic fuel injector as defined by claim 1, wherein the electric solenoid comprises:

an electric solenoid stator mounted on the housing, the stator having a stator core and an electric coil wound thereon, the coil being controllably connected to a source of electric energy; and an electric solenoid armature movably mounted within the housing magnetically proximate the stator core and resiliently biased away therefrom.

3. The high-pressure electromagnetic fuel injector as defined by claim 1, wherein the housing further defines therein:

a dual-function valve chamber in communication with the fuel drain passage;

a control volume chamber;

a first orifice extending between the dual-function valve chamber and the control volume chamber;

a second orifice extending between the control volume chamber and the fuel supply passage, the first orifice having a greater capacity for fuel flow than does the second orifice;

a control valve chamber in communication with the fuel supply passage;

a spray tip valve chamber;

a fuel spill passage extending from the dual-function valve chamber to the control valve chamber and to the spray tip valve chamber; and a spray tip orifice extending from the spray tip valve chamber to carry fuel to its point of ejection from the housing.

4. The high-pressure electromagnetic fuel injector as defined by claim 3, wherein the dual-function valve means comprise:

a dual-function valve slidably disposed within the dual-function valve chamber and rigidly connected to the electric solenoid armature, the dual-function valve having a resiliently maintained normal position isolating the first orifice from the fuel drain passage and allowing communication between the fuel spill passage and the fuel drain passage and being slidable, when the electric solenoid is energized, to a position isolating the fuel spill passage from the fuel drain passage and allowing fuel flow between the first orifice and the fuel drain passage.

5. The high-pressure electromagnetic fuel injector as defined by claim 4, wherein the electric solenoid armature is resiliently biased away from the stator core by an armature coil spring disposed within the housing.

6. The high-pressure electromagnetic fuel injector as defined by claim 4, wherein the control volume means comprise a control volume chamber, the first orifice extending between the dual-function valve chamber and the control volume chamber and the second orifice extending between the control volume chamber and the fuel supply passage, the first orifice having a greater capacity for fuel flow than does the second orifice, fuel pressure in the control volume chamber being reduced when the dual-function valve allows fuel flow between the first orifice and the fuel drain passage.

7. The high-pressure electromagnetic fuel injector as defined by claim 6, wherein the control valve means comprise:

a control valve slidably disposed within the control valve chamber and extending into the control volume chamber, the control valve having a resiliently maintained normal position isolating the fuel supply passage from the fuel spill passage and providing communication between the fuel supply passage and the first orifice, the control valve being responsive to reduced fuel pressure in the control volume chamber and having a differential portion responsive to fuel pressure in the control valve chamber to urge the control valve away from its normal position to a position that allows fuel flow between the fuel supply passage and the fuel spill passage and that allows restricted fuel flow from the fuel supply passage, through the first orifice, to the fuel drain passage.

8. The high-pressure electromagnetic fuel injector as defined by claim 7, wherein the control valve is maintained in its normal position by a control valve coil spring disposed within the control volume chamber.

9. The high-pressure electromagnetic fuel injector as defined by claim 7, wherein the spray tip valve means comprise:

a spray tip valve slidably disposed in the spray tip chamber and having a resiliently maintained normal position isolating the fuel spill passage from the spray tip orifice, thereby preventing any fuel from being ejected, the spray tip valve having a differential portion responsive to fuel pressure in the spray tip valve chamber to urge the spray tip valve away from its normal position to a position allowing communication between the fuel spill passage and the spray tip orifice, thereby allowing fuel to be ejected from the injector until the electric solenoid is no longer energized, whereupon the dual-function valve allows fuel to flow from the fuel spill passage to the fuel drain passage and a resulting increase in control volume chamber fuel pressure causes the control valve to isolate the fuel supply passage from the fuel spill passage.

10. The high-pressure electromagnetic fuel injector as defined by claim 9, wherein the spray tip valve is resiliently maintained in its normal position by a spray tip valve coil spring disposed within the housing.

11. The high-pressure electromagnetic fuel injector as defined by claim 9, wherein the dual-function valve, the control valve and the spray tip valve move reciprocally along a common axis.

12. A high-pressure electromagnetic fuel injector, comprising:

a housing defining therein a fuel supply passage connectable to a source of high-pressure fuel and a fuel drain passage connectable to a fuel source return, the housing further defining therein a dual-function valve chamber in communication with the fuel drain passage, a control volume chamber, a first orifice extending between the dual-function valve chamber and the control volume chamber, a second orifice extending between the control volume chamber and the fuel supply passage, the first orifice having a greater capacity for fuel flow than does the second orifice, a control valve chamber in communication with the fuel supply passage, a spray tip valve chamber, a fuel spill passage extending from the dual-function valve chamber to the control valve chamber and to the spray tip valve chamber, and a spray tip orifice extending from the spray tip valve chamber to carry fuel to its point of ejection from the housing;

an electric solenoid stator mounted on the housing, the stator having a stator core and an electric coil wound thereon, the coil being controllably connected to a source of electric energy;

an electric solenoid armature movably mounted within the housing magnetically proximate the stator core and resiliently biased away therefrom;

a dual-function valve slidably disposed within the dual-function valve chamber and rigidly connected to the electric solenoid armature, the dual-function valve having a resiliently maintained normal position isolating the first orifice from the fuel drain passage and allowing communication between the fuel spill passage and the fuel drain passage and being slidable, when the electric solenoid is energized, to a position isolating the fuel spill passage from the fuel drain passage and allowing communication between the first orifice and the fuel drain passage;

a control valve slidably disposed within the control valve chamber and extending into the control volume chamber, the control valve having a resiliently maintained normal position isolating the fuel supply passage from the fuel spill passage and allowing restricted communication between the fuel supply passage and the fuel drain passage, the control valve having a differential portion responsive to fuel pressure to urge the control valve away from its normal position to a position allowing communication between the fuel supply passage and the fuel spill passage and isolating the fuel supply passage from the fuel drain passage; and a spray tip valve slidably disposed in the spray tip chamber and having a resiliently maintained normal position isolating the fuel spill and fuel supply passages from the spray tip orifice, thereby preventing any fuel from being ejected, the spray tip valve having a differential portion responsive to fuel pressure to urge the spray tip valve away from its normal position to a position allowing communication between the fuel spill and fuel supply passages and the spray tip orifice, thereby allowing fuel to be ejected from the injector until the electric solenoid is no longer energized.

13. The high-pressure electromagnetic fuel injector as defined by claim 12, wherein the electric solenoid armature is resiliently biased away from the stator core by an armature coil spring disposed within the housing.

14. The high-pressure electromagnetic fuel injector as defined by claim 12, wherein the control valve is maintained in its normal position by a control valve coil spring disposed within the control volume chamber.

15. The high-pressure electromagnetic fuel injector as defined by claim 12, wherein the spray tip valve is resiliently maintained in its normal position by a spray tip valve coil spring disposed within the housing.

16. The high-pressure electromagnetic fuel injector as defined by claim 12, wherein the dual-function valve, the control valve and the spray tip valve move reciprocally along a common axis.

* * * * *